US006174051B1

(12) United States Patent
Sakaida

(10) Patent No.: US 6,174,051 B1
(45) Date of Patent: Jan. 16, 2001

(54) INK JET HEAD

(75) Inventor: Atsuo Sakaida, Gifu (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 08/911,011

(22) Filed: Aug. 14, 1997

(30) Foreign Application Priority Data

Aug. 19, 1996 (JP) ..... 8-217366

(51) Int. Cl.[7] ..... B41J 2/045
(52) U.S. Cl. ..... 347/72
(58) Field of Search ..... 347/68–72; 310/328

(56) References Cited

U.S. PATENT DOCUMENTS

| | | | | |
|---|---|---|---|---|
| 4,584,590 | | 4/1986 | Fischbeck et al. . | |
| 4,825,227 | | 4/1989 | Fischbeck et al. . | |
| 5,086,308 | | 2/1992 | Takahashi et al. . | |
| 5,266,964 | * | 11/1993 | Takahashi et al. | 347/72 |
| 5,376,857 | * | 12/1994 | Takeuchi et al. | 310/328 |
| 5,550,373 | * | 8/1996 | Cole et al. | 307/400 |

FOREIGN PATENT DOCUMENTS

| | | | | |
|---|---|---|---|---|
| 3-49957 | | 3/1991 | (JP) . | |
| 4-125157 | | 4/1992 | (JP) . | |
| 406166179 | * | 6/1994 | (JP) | 347/69 |

* cited by examiner

*Primary Examiner*—John Barlow
*Assistant Examiner*—Michael S. Brooke
(74) *Attorney, Agent, or Firm*—Oliff & Berridge, PLC

(57) ABSTRACT

In an ink jet head, an actuating voltage is applied from an actuating power source V to each first inner electrode 26 when a selected switch S is actuated. An electric field is generated in a laminated piezoelectric element 23 in a direction perpendicular to a polarizing direction thereof, whereby the laminated piezoelectric element 23 is deformed in a shear mode. At the same time, an electric field is generated in an outer piezoelectric layer 24 in a direction parallel to a polarizing direction thereof, whereby the outer piezoelectric layer 24 is deformed in an expansion mode. The volume of an ink pressure chamber 21 is then reduced to eject the ink in the ink pressure chamber 21 from an ink ejecting orifice (not shown) onto a printing sheet. Thus, letters and the like are printed on the sheet.

16 Claims, 5 Drawing Sheets

INK JET HEAD

BACKGROUND OF THE INVENTION

1. Field of the Invention

The present invention relates to an ink jet head which ejects ink from an ink ejecting orifice by applying an actuating voltage to a selected inner electrode provided in a piezoelectric layer covering an open plane of an ink pressure chamber formed in a cavity plate.

More particularly, the present invention relates to an ink jet head which utilizes a laminated piezoelectric element constructed of at least two or more piezoelectric layers and polarized in the laminating direction and an outer piezoelectric layer stacked on one plane of the laminated piezoelectric element and polarized in a direction of thickness, the ink jet head being capable of increasing electromechanical transducing efficiency of the laminated piezoelectric element with low actuating voltage and attaining a large deformation of the entire piezoelectric element by a cooperative effect of a shear mode deformation of the laminated piezoelectric element and an expansion mode deformation of the outer piezoelectric layer, and also enhancing rigidity of the ink pressure chamber to reduce loss of the pressure generated therein by applying an actuating voltage to the laminated piezoelectric element to produce an electric field in the laminated piezoelectric element in a perpendicular direction to the polarized direction, whereby the laminated piezoelectric element is deformed in a shear mode and to produce an electric field in the outer piezoelectric layer in a direction parallel to the polarizing direction, whereby the outer piezoelectric layer is deformed in an expansion mode.

2. Description of Related Art

Conventionally, various types of ink jet heads for use in ink jet printers have been proposed. There is, for example, an ink jet head comprising a piezoelectric element fixedly provided on an open plane of an ink pressure chamber formed in a cavity plate, in which when an actuating pulse is applied to an electrode provided in the piezoelectric element, the piezoelectric element is deformed in a shear mode, which causes the change in the volume of the ink pressure chamber to jet an ink drop through an ink jetting orifice.

For example, in U.S. Pat. No. 4,825,227, disclosed is an ink jet head in which an ink pressure chamber is constructed of a chamber plate and a fixing plate, and provided with a single piezoelectric layer on an open plane (upper plane) of the ink pressure chamber. This ink jet head also comprises two electrodes mounted on an upper surface of the piezoelectric layer and at a position corresponding to an edge of each ink pressure chamber and a common electrode mounted on an entire lower surface of the piezoelectric layer. In such the ink jet head, the piezoelectric layer is polarized parallel to the plane of the layer so that the direction of polarization extends along the plane of the piezoelectric layer from the center of each pressure chamber. When an actuating voltage is applied between the two electrodes with opposite polarities, an electric field is generated orthogonal to the direction of polarization of the piezoelectric layer, causing the piezoelectric layer to be deformed in a shear mode to change the volume of the ink pressure chamber. The ink jet head thus jets the ink in the ink pressure chamber via an ink jetting orifice in accordance of the change of the volume of the ink pressure chamber.

Furthermore, in U.S. Pat. No. 4,584,590, disclosed is an ink jet head provided with ink pressure chambers formed in a main plate, a single piezoelectric layer fixedly mounted on an open plane (upper plane) of each ink pressure chamber and electrodes disposed on the opposite surfaces of the piezoelectric layer corresponding to each ink pressure chamber and different electrodes disposed adjacent to an edge away from the ink pressure chamber. In such the ink jet head, the piezoelectric layer is polarized in a direction of thickness of the piezoelectric layer, in which when an actuating voltage is applied to each electrode disposed corresponding to each ink pressure chamber, an electric field is generated in a direction perpendicular to the polarization, thereby causing deformation of the piezoelectric layer in a shear mode. Thus the volume of the ink pressure chamber is changed to jet the ink in the ink pressure chamber via an ink ejecting orifice.

The conventional two ink jet heads, which are different in the polarizing direction of a piezoelectric layer, are common in the following points. One is that application of an actuating voltage between electrodes formed with a space therebetween in the piezoelectric layer causes the generation of an electric field in a direction perpendicular to each polarization direction, thereby causing a shear mode deformation in the piezoelectric layer and changing the volume of the ink pressure chamber, so that ink is jetted via an ink ejecting orifice according to the change in the volume of the ink pressure chamber. Another is that they utilize a single piezoelectric layer.

There is also known an ink jet head utilizing a laminated piezoelectric element constructed of two or more laminated piezoelectric layers. The laminated piezoelectric element used in this type of the ink jet head is a piezoelectric element which is deformed in a so-called expansion mode utilizing a transversal effect mode or a longitudinal effect mode. The ink jet head adopts a structure where a diaphragm and the like is arranged between the piezoelectric element and the ink pressure chamber.

Also in Japanese Patent Application laid-open No. 4-125157, for example, an ink jet head using a laminated piezoelectric element is proposed, in which application of an actuating voltage to the laminated piezoelectric element causes the generation of an electric field in a direction substantially perpendicular to the polarizing direction in the piezoelectric element, thereby deforming the same in a shear mode and changing the volume of a selected ink channel. The ink jet head thus ejects ink according to the change of the volume of the ink channel (see Japanese Patent Application laid-open No. 4-125157 and the like).

However, the above ink jet heads disclosed in U.S. Pat. No. 4,825,227 and No. 4,584,590 are disadvantageous in that, although the direction of the electric field generated upon application of an actuating voltage between electrodes in the piezoelectric layer to jet ink via the ink ejecting orifice is perpendicular to the polarization direction of the piezoelectric layer, the orthogonality between the direction of the electric field and the polarization direction is low due to the use of a single piezoelectric layer. Accordingly, the piezoelectric layer has only a very small electromechanical transducing efficiency upon application of an actuating voltage, so that high actuating voltage is required to increase the electromechanical transducing efficiency of the piezoelectric layer.

The electromechanical transducing efficiency of the piezoelectric layer may be increased if the thickness of the layer is made thin; however, such a thin piezoelectric layer is deteriorated in strength and may be bent in jetting ink in the ink pressure chamber because the piezoelectric layer itself forms one of walls constructing the ink pressure chamber. As a result, there is a problem of causing a deterioration in the pressure generated in the ink pressure chamber.

On the other hand, in the ink jet head disclosed in U.S. Pat. No. 4,825,227, the common electrode formed in the piezoelectric layer on the side toward the ink pressure chamber becomes into direct contact with ink in the ink pressure chamber, there may largely occur corrosion in the common electrode. To avoid the corrosion, an epoxy layer may be provided on the electrode formed in the piezoelectric layer on the side toward the ink pressure chamber so as to cover the electrode from the ink in the ink pressure chamber, as disclosed in aforesaid U.S. Pat. No. 4,584,590. However, the epoxy layer may produce a limitation in deformation of the piezoelectric layer due to the rigidity of the epoxy layer. Movement of the piezoelectric layer is accordingly lowered in jetting ink in accordance with an actuating voltage applied between the electrodes, so that the ink can not be properly jetted via the ink jetting orifice.

The ink jet head utilizing a laminated piezoelectric element, in which the laminated piezoelectric element is deformed in an expansion mode, needs a diaphragm for transmitting the expansive deformation of the laminated piezoelectric element to the ink pressure chamber thereby to jet ink therefrom, resulting in high cost. To achieve a multinozzle head having high resolution, furthermore, two ways are conceivable in case of the use of a laminated piezoelectric element of an expansion mode, namely, one is to arrange a plurality of the piezoelectric elements at a micro pitch and another is to apply recessing process to a single piezoelectric element at a micro pitch. Any ways have a limitation in manufacturing a structure at a micro pitch, and are not suitable for a head with high resolution.

In the ink jet head for jetting ink by deforming a laminated piezoelectric element in a shear mode, the laminated piezoelectric element is constructed of a plurality of piezoelectric layers, so that it has a good electromechanical transducing efficiency and does not need high actuating voltage. However, the laminated piezoelectric element is deformed only in a shear mode, which is not still sufficient in view of the transducing efficiency of the laminated piezoelectric element.

SUMMARY OF THE INVENTION

The present invention has been made in view of the above circumstances and has an object to overcome the above problems and to provide an ink jet head utilizing a laminated piezoelectric element constructed of at least two or more piezoelectric layers, polarized in a direction of lamination and an outer piezoelectric layer provided on a plane of the laminated piezoelectric element, polarized in a direction of thickness, in which an electric field is produced in a direction perpendicular to the polarizing direction of the laminated piezoelectric element upon application of an actuating voltage to the laminated piezoelectric element, whereby the laminated piezoelectric element is deformed in a shear mode, while an electric field is produced in a direction parallel to the polarizing direction of the outer piezoelectric layer, whereby the outer piezoelectric layer is deformed in an expansion mode, so that the whole piezoelectric element can be largely deformed due to a cooperative effect of a shear mode deformation of the laminated piezoelectric element and an expansion mode deformation of the outer piezoelectric layer while enhancing electromechanical transducing efficiency of the laminated piezoelectric element with low actuating voltage, and the rigidity of the ink pressure chamber is enhanced to reduce loss of the pressure produced in the ink pressure chamber. It is also an object of the invention to provide an ink jet head capable of covering electrodes provided in the laminated piezoelectric element from the ink in the ink chamber without adding any insulating layers such as an insulating film and the like and any diaphragms and also without limiting movement of the laminated piezoelectric element.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an ink jet head of this invention including ink pressure chambers formed in a cavity plate, each ink pressure chamber being open in one plane thereof; a piezoelectric layer fixed in the cavity plate so as to cover the open plane of the ink pressure chamber and comprising first inner electrodes each disposed at a position corresponding to each ink pressure chamber and second inner electrodes each disposed in a periphery of the ink pressure chamber; a power source having a first terminal to which the first inner electrodes are connected and a second terminal to which the second inner electrodes are connected and has a polarity different from the first terminal; the first and second inner electrodes produce electric deformation of a part of the piezoelectric layer upon application of an actuating voltage between the first and second inner electrodes from the power source, to jet ink from the ink pressure chamber via an ink jetting orifice, the ink jet head comprising:

a laminated piezoelectric element formed of the at least two or more piezoelectric layers so that the first and second inner electrodes are individually stacked up, the laminated piezoelectric element being polarized in a direction of lamination;

an outer piezoelectric layer stacked on one surface of the laminated piezoelectric element and polarized in a direction of thickness; and an outer electrode formed on one side of the outer piezoelectric layer, connected to the second terminal of the power source;

wherein, upon application of the actuating voltage from the power source, an electric field in a direction perpendicular to the polarization direction of the laminated piezoelectric element is generated in the laminated piezoelectric element to deform the same in a shear mode, and an electric field in a direction parallel to the polarization direction of the outer piezoelectric layer is generated in the outer piezoelectric layer to deform the same in an expansion mode.

According to the ink jet head of the present invention, if an actuating voltage is applied between the first and second inner electrodes from a power source in operation, an electric field is generated in the laminated piezoelectric element therebetween in a direction perpendicular to the polarization direction of the laminated piezoelectric element, whereby the laminated piezoelectric element is deformed in a shear mode, and an electric field is generated in the outer piezoelectric layer between the outer electrode connected to the second terminal of the power source and the first inner electrode in the outermost layer of the laminated piezoelectric element adjacent to the outer piezoelectric layer, in a direction parallel to the polarization direction of the outer piezoelectric layer, whereby the outer piezoelectric layer is deformed in an expansion mode.

In this way, deformation of the laminated piezoelectric element in a shear mode and, synchronously, deformation of the outer piezoelectric element in an expansion mode due to the electric field generated in a direction parallel to the polarizing direction make it possible to enhance electromechanical transducing efficiency of the laminated piezoelectric element with a low actuating voltage and to deform largely the whole piezoelectric element due to a cooperative effect of the shear mode deformation of the laminated piezoelectric element and the expansion mode deformation of the outer piezoelectric layer.

Using a laminated piezoelectric element, rigidity of the ink chamber can be enhanced as compared with the case where a single piezoelectric layer is used, thereby to reduce the loss of a pressure generated in the ink chamber.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of preferred embodiments of an ink jet head embodying the present invention will now be given referring to the accompanying drawings.

Figure 1:
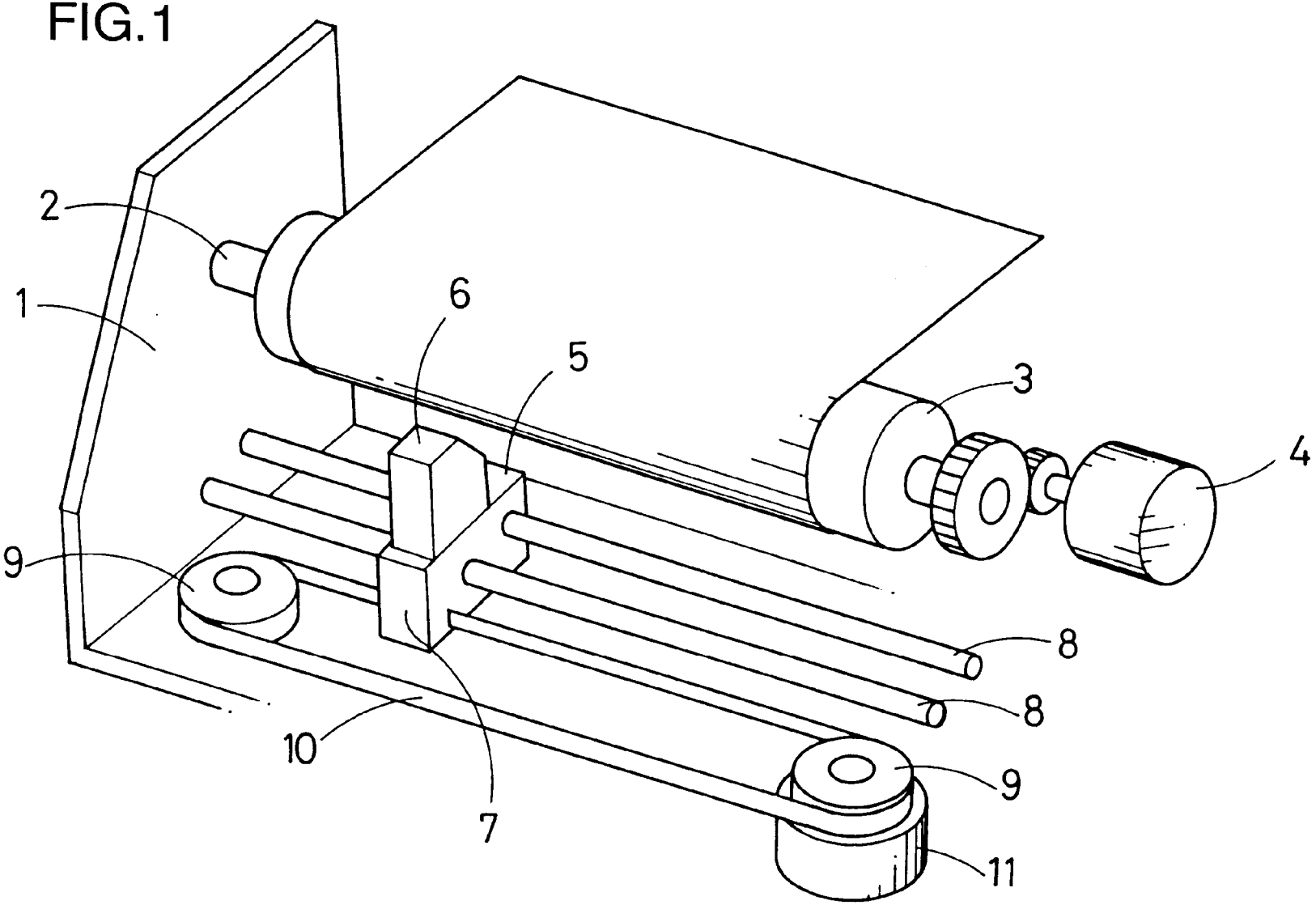
FIG. 1 is a perspective view of a main part of an ink jet printer according to a first embodiment of the present invention.

First, a schematic structure of an ink jet printer on which an ink jet head according to the first embodiment of the present invention is mounted is explained with reference to FIG. 1. FIG. 1 is a perspective view of a main part of the ink jet printer.

In FIG. 1, a platen 3 is rotatably connected to a pair of frames 1 (only one of which is illustrated in the drawing) by means of an axle 2. This platen 3 is actuated by a motor 4 to rotate. A piezoelectric ink jet head 5 is fixed facing the platen 3. The head 5 and an ink supply unit 6 are mounted on a carriage 7. The carriage 7 is slidably supported on a pair of guide rods disposed parallel to the axial direction of the platen 3. The carriage 7 is connected with a timing belt 10 which is wound on a pair of pulleys 9. One of the pulleys 9 (a right one in the drawing) is fixed to an driving axle of a motor 11. When the motor 11 rotates the right pulley 9, the carriage 7 moves along the platen 3 in accordance with the movement of the timing belt 10.

Next, a structure of the piezoelectric ink jet head 5 will be described with reference to FIG. 2, which is a sectional view of a part of an array structure of the piezoelectric ink jet head 5 according to the first embodiment. The piezoelectric ink jet head 5 in the first embodiment is an ink jet head of a push-jet type which jets ink upon application of an actuating voltage.

Figure 2:
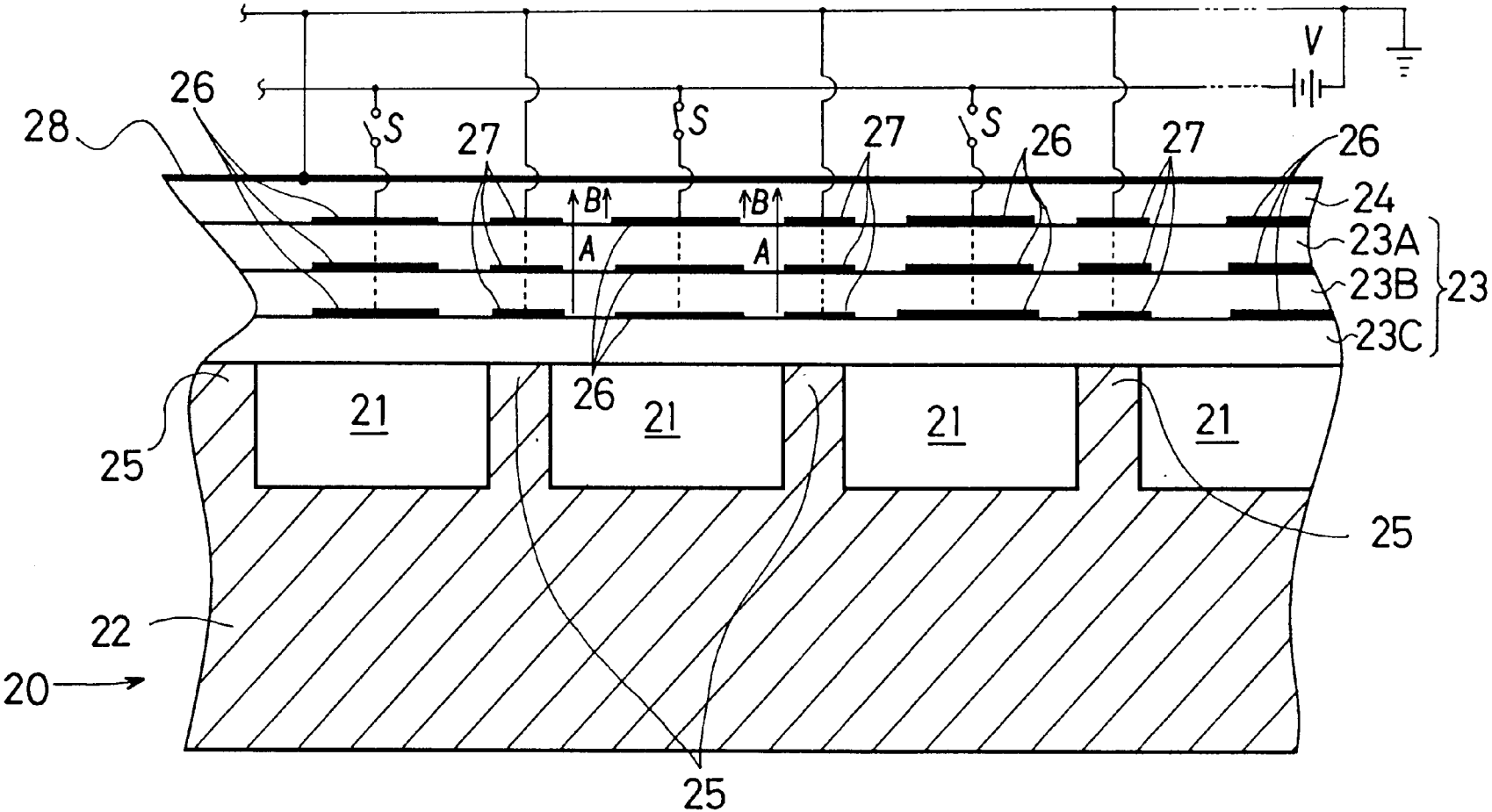
FIG. 2 is a sectional view of a part of an array structure of a piezoelectric ink jet head according to the first embodiment of the present invention.

In FIG. 2, an array 20 used in the piezoelectric ink jet head 5 comprises a cavity plate 22 in which a plurality of ink pressure chambers 21 are formed and open in each top surface thereof, a laminated piezoelectric element 23 fixed on the top surface of the cavity plate 22 with adhesive agent so as to cover each open surface of the ink pressure chambers 21, and an outer piezoelectric ceramic layer 24 laminated on the top surface of an uppermost layer of the laminated piezoelectric element 23.

Each ink pressure chamber 21 is formed in the cavity plate by a cutting treatment and the like. The adjacent ink pressure chambers 21 are divided by a dividing wall 25.

The laminated piezoelectric element 23 comprises a plurality of piezoelectric ceramic layers having a piezoelectric effect and an electrostrictive strain effect. In FIG. 2, for example, three piezoelectric ceramic layers are laminated. To facilitate explanation, they are herein referred to as a first, a second, and a third piezoelectric ceramic layers 23A, 23B, and 23C in order downward from the upper most layer adjacent to the outer piezoelectric ceramic layer 24. On the first and second piezoelectric ceramic layers 23A and 23B, first inner electrodes 26 are formed at positions corresponding to each ink pressure chamber 21 and second inner electrodes 27 are formed in a periphery of each chamber, namely, at positions corresponding to each dividing wall 25 between the adjacent ink pressure chambers 21.

Similarly, the third piezoelectric ceramic layer 23C is provided on one plane thereof with the first and second inner electrodes 26 and 27 as well as the first and second piezoelectric ceramic layers 23A and 23B, and on another plane facing each ink pressure chamber 21 with no electrode and the like. This is because the third piezoelectric ceramic layer 23C is made to operate as an insulating layer to prevent the first electrodes 26 formed on the second piezoelectric ceramic layer 23B stacked on the third piezoelectric ceramic layer 23C from becoming contact with the ink in the ink chambers 21, thereby to protect the electrode layers formed in the laminated piezoelectric element 23 from the ink in the ink pressure chambers without adding any insulating layer such as an insulating film and the like and any diaphragm.

The third piezoelectric ceramic layer 23C can be formed at the same time when the first and second piezoelectric layers 23A and 23B are formed in manufacture of the laminated piezoelectric element 23, resulting in a decrease in the cost of manufacture.

As shown in FIG. 2, the first, second, and third piezoelectric ceramic layers 23A, 23B, and 23C are laminated on each other so that first inner electrodes 26 and second inner electrodes 27 are individually stacked up. The laminated piezoelectric element 23 having a structure described above is polarized in a direction in which the first through third piezoelectric ceramic layers 23A through 23C are laminated, as indicated by arrows A in FIG. 2. Each first inner electrode 26 in the first through third piezoelectric ceramic layers 23A through 23C is connected with a positive terminal of an actuating power source V via switches S. Each second inner electrode 27 is connected with a negative terminal of the actuating power source V.

The outer piezoelectric ceramic layer 24 is formed at the same time in manufacture of the laminated piezoelectric element 23. An outer electrode 28 is provided on an entire top surface of the outer piezoelectric ceramic layer 24. The outer piezoelectric ceramic layer 24 is polarized in a direction of thickness, as indicated by arrows B in FIG. 2. The outer electrode 28 is connected to a negative terminal of the actuating voltage V.

It is noted that a manufacturing process of the laminated piezoelectric element 23 and the outer piezoelectric ceramic layer 24 and a polarizing process thereof are the same as those described in Japanese Patent Application laid-open No. 4-125157 and others, and detail explanation of which will be omitted herein.

Figure 3:
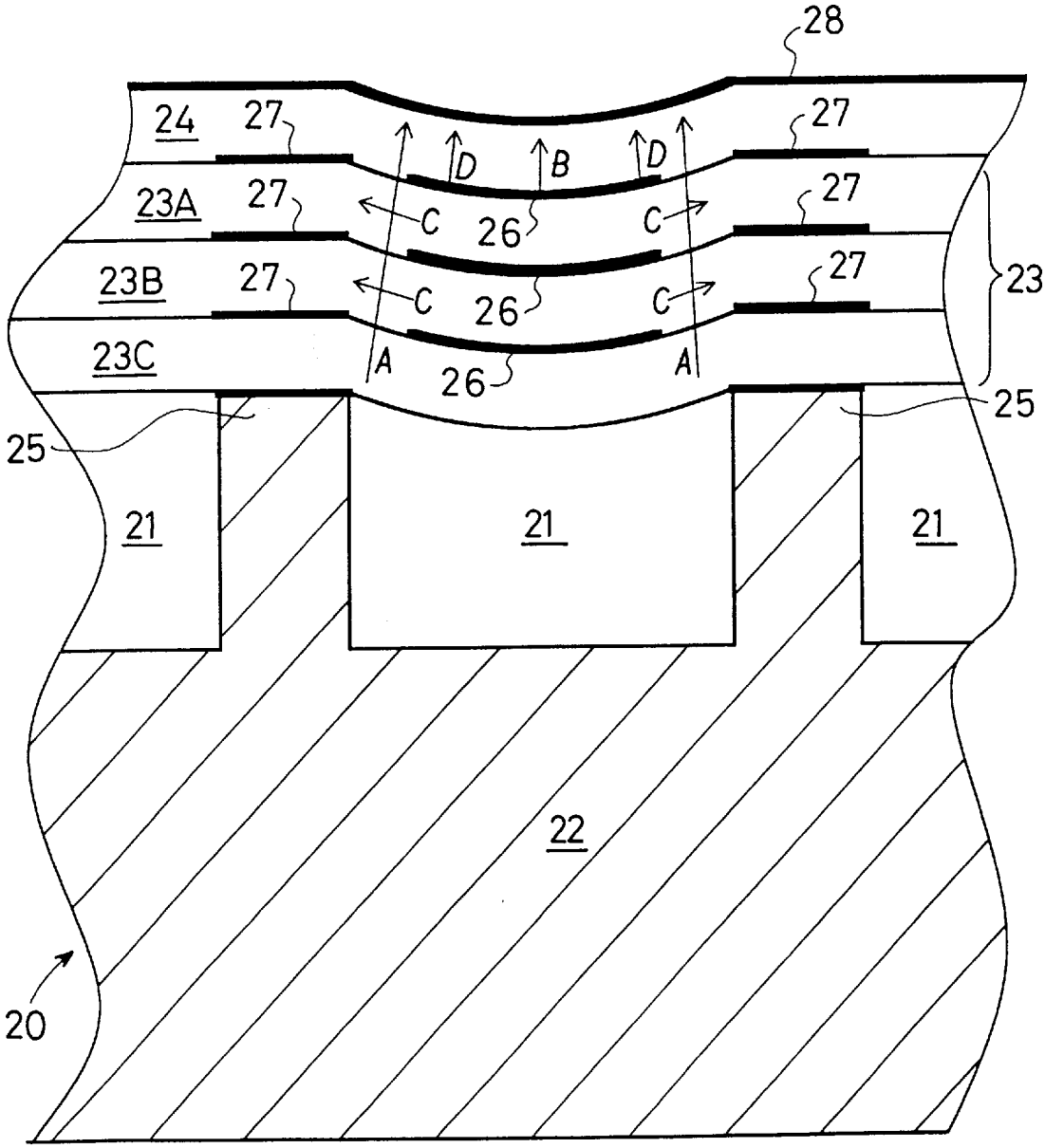
FIG. 3 is an enlarged sectional view of a part of the array in which a laminated piezoelectric element is deformed in printing operation in the first embodiment.

Operation of the array 20 in the ink jet head 5 constructed as above will be explained referring to FIG. 3. FIG. 3 is an enlarged sectional view of a part of the array 20 in operation of printing by deforming the laminated piezoelectric element 23. Here, explanation is made about each operation of the laminated piezoelectric element 23 and the outer piezoelectric ceramic layer 24 when the switch S corresponding to a selected one of the ink pressure chamber 21, which is the second one from the right in FIG. 2, is actuated.

In FIG. 3, when the switch S is actuated via a controller (not shown) according to predetermined printing data, an actuating voltage is applied to each first inner electrode 26 via the actuating power source V. At this time, since each first inner electrode 26 is connected to a positive terminal of the actuating power source V and each second inner electrode 27 is connected to a negative terminal of the same, an electric field in a direction substantially perpendicular to the polarization direction of the laminated piezoelectric element 23 indicated by arrows A is generated between the first and second inner electrodes 26 and 27. The direction of the electric field generated is indicated by arrows C in FIG. 3. Accordingly, the first and second piezoelectric layers 23A and 23B are partially deformed as shown in the drawing in a shear mode due to a piezoelectric effect and an electrostrictive strain effect. The third piezoelectric ceramic layer 23C, which is formed of the same layer (constituent) as the first and second piezoelectric ceramic layer 23A and 23B, is deformed following the deformation of the first end second piezoelectric ceramic layers 23A and 23B in a shear mode.

Furthermore, the outer electrode 28 of the outer piezoelectric ceramic layer 24 is connected to a negative terminal of the actuating power source V. When the switch S is actuated as described above, an electric field in the direction parallel to the polarization direction of the outer piezoelectric ceramic layer 24 indicated by an arrow B is generated between the first inner electrode 26 and the outer electrode 28. The direction of the electric field generated is indicated by arrows D in FIG. 3. A part of the outer piezoelectric ceramic layer 24 is then deformed due to a piezoelectric and electrostrictive strain effect. Specifically, the part of the outer piezoelectric ceramic layer 24 corresponding to the first inner electrode 26 expands in a direction of thickness of the layer 24 and contracts in a direction parallel to the plane of the layer 24, whereby the outer piezoelectric ceramic layer 24 is partially bent downward as shown in the drawing owing to a bimorph effect between the layer 24 and the first piezoelectric ceramic layer 23A adjacent thereto.

As described above, when the switch S is actuated, the laminated piezoelectric element 23 is deformed in a shear mode due to the electric field generated in the direction perpendicular to the polarization direction of the laminated piezoelectric element 23 upon application of an actuating voltage from the actuating power source V to each first inner electrode 26, synchronously, the outer piezoelectric ceramic layer 24 is deformed in an expansion mode due to the electric field generated in the direction parallel to the polarization direction of the outer piezoelectric ceramic layer 24. The volume of the ink chamber 21 is then reduced. This allows the ink in the ink chamber 21 to be jetted via an ink jetting orifice (not shown) onto a printing sheet to print desired letters and the like thereon.

In this way, in the ink jet head 5 according to the first embodiment, the laminated piezoelectric element 23 is deformed in the shear mode and the outer piezoelectric ceramic element 24 is deformed in the expansion mode at the same time in printing operation, so that the electromechanical transducing efficiency of the laminated piezoelectric element 23 can be enhanced with low actuating voltage and also an cooperative effect of the shear mode deformation of the laminated piezoelectric element 23 and the expansion mode deformation of the outer piezoelectric layer 24 produces a bimorph deformation, thereby enabling a large deformation of the whole piezoelectric element. The use of the laminated piezoelectric element 23 can enhance the rigidity of the ink pressure chamber 21 and reduce the loss of the pressure generated in the ink pressure chamber 21.

The piezoelectric ceramic layer 23C among the piezoelectric ceramic layers 23A through 23C of the laminated piezoelectric element 23, which is in contact with the ink in the ink pressure chamber 21, operates as an insulating layer, so that the electrode layers formed in the laminated piezoelectric element 23 can be prevented from becoming contact with the ink owing to the piezoelectric ceramic layer 23C. This makes it possible to protect the electrode layers in the laminated piezoelectric element 23 from the ink in the ink pressure chamber 21 without additionally providing any insulating layer such as an insulating film and any diaphragm and the like. Since the piezoelectric ceramic layer 23C operating as an insulating layer can be formed together with other piezoelectric ceramic layers 23A and 23B in the manufacture of the laminated piezoelectric element 23, which does not cause an increase in the cost of manufacture.

The piezoelectric ceramic layer 23C in contact with the ink in the ink pressure chamber 21 is formed of the same layer as the piezoelectric ceramic layers 23A and 23B of the laminated piezoelectric element 23, so that the piezoelectric ceramic layer 23C can easily be deformed in accordance with the deformation of the laminated piezoelectric element 23. Accordingly, the first inner electrodes 26 formed in the laminated piezoelectric element 23 can be protected from the ink in the ink pressure chamber 21 without limiting the movement of the laminated piezoelectric element 23.

In the first embodiment described above, if reversing respective polarization directions of the laminated piezoelectric element 23 and the outer piezoelectric ceramic layer 24 from the above directions, they can be deformed in the reversed directions respectively, namely, in the direction in which the volume of the ink pressure chamber 21 is increased. The present invention can be also applied to an ink jet head of a suction-jet type which will be described later.

Figure 4:
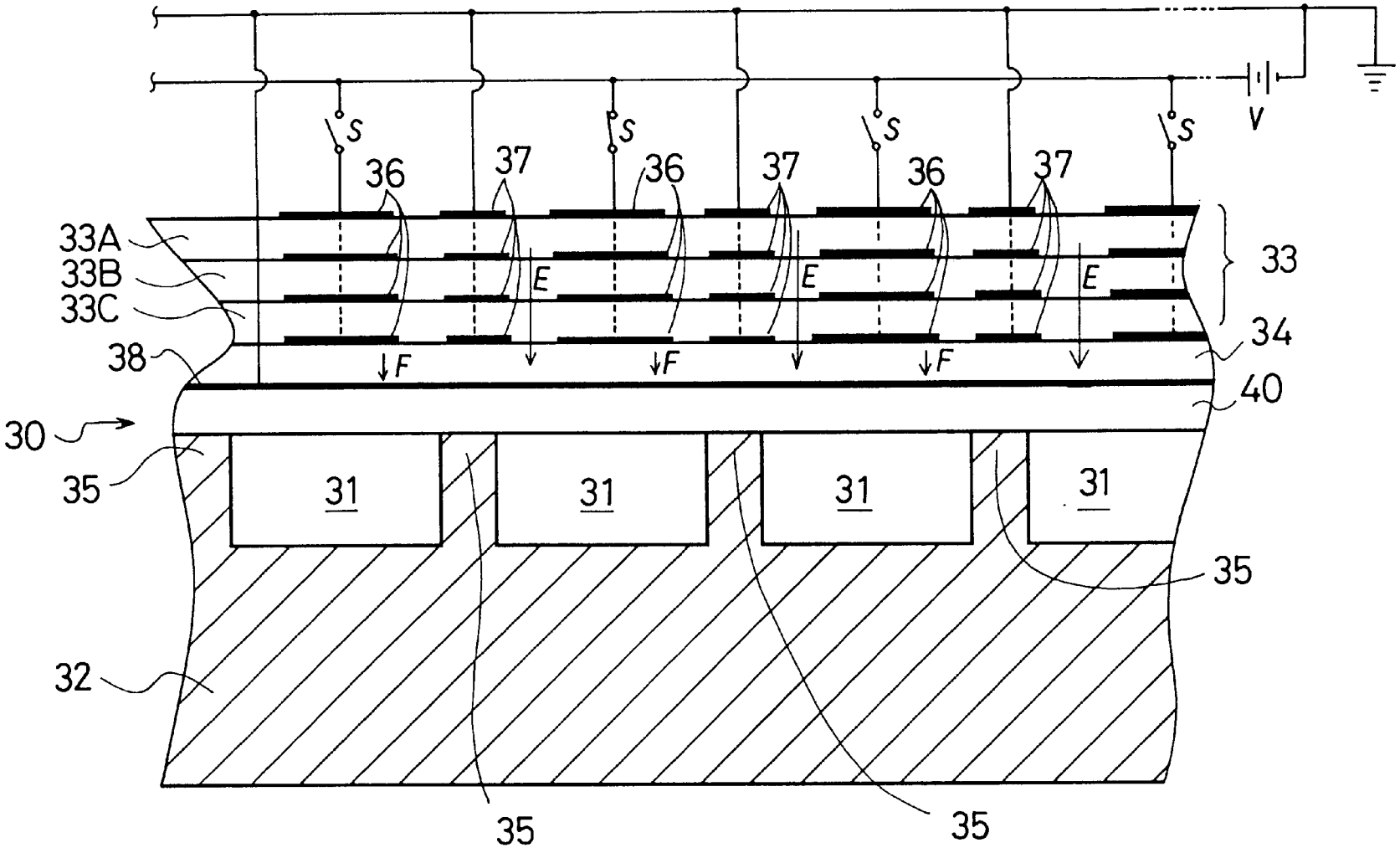
FIG. 4 is a sectional view of a part of an array structure of a piezoelectric ink jet head according to a second embodiment of the present invention.

An array structure of the ink jet head 5 in the second embodiment will be explained hereinafter with reference to FIG. 4. FIG. 4 is a sectional view of a part of the array structure of the piezoelectric ink jet head 5 in the second embodiment, wherein this ink jet head 5 is a suction-jet type which performs a sucking operation to suck ink upon application of an actuating voltage and then a jetting operation to jet the ink upon break of the actuating voltage.

In FIG. 4, an array 30 of the piezoelectric ink jet head 5 is constructed of a cavity plate 32 in which a plurality of ink pressure chambers 31 whose top planes are open are formed, a piezoelectric ceramic layer 40 fixed on the cavity plate 32 with adhesive agent so as to cover each open plane of the ink pressure chambers 31, an outer piezoelectric ceramic layer 34 stacked on the upper plane of the piezoelectric ceramic layer 40, and a laminated piezoelectric element 33 stacked on the upper plane of the outer piezoelectric ceramic layer 34. It is noted that the piezoelectric ceramic layer 40, the outer piezoelectric ceramic layer 34, and the laminated piezoelectric element 33 are individually explained for convenience in the embodiment, whereas they are actually formed in an integral body.

Each ink pressure chamber 31 is formed in the cavity plate 32 by a cutting treatment and the like. The adjacent ink pressure chambers 31 are divided by a dividing wall 35.

An outer electrode 38 is provided on an upper surface of the piezoelectric layer 40 disposed under the outer piezoelectric ceramic layer 34. The outer electrode 38 is connected to a negative terminal of the actuating power source V, which is a necessary electrode for deforming the outer piezoelectric ceramic layer 34 in the expansion mode. The piezoelectric ceramic layer 40 is a piezoelectric layer which comes into contact with the ink in the ink pressure chamber 31 and operates as an insulating layer for protecting the outer piezoelectric ceramic layer 34 and the laminated piezoelectric element 33 from the ink. Accordingly, with the piezoelectric ceramic layer 40 operating as an insulating layer, the outer electrode 38 provided under the outer piezoelectric ceramic layer 34 is prevented from becoming contact with the ink, and also the laminated piezoelectric element 33 is protected from the ink in the ink pressure chamber without additionally providing any insulating layer such as an insulating film and any diaphragm and the like. The piezoelectric ceramic layer 40 can be formed together with the first through third piezoelectric ceramic layers 33A through 33C which will be described later in manufacture of the laminated piezoelectric element 33, so that an increase in the cost of manufacture is not caused.

On the outer piezoelectric ceramic layer 34, first inner electrodes 36 are provided corresponding to each ink pressure chamber 31 and second inner electrodes 37 are provided corresponding to each dividing wall 35. The outer piezoelectric ceramic layer 34 is polarized in the direction of thickness as indicated by arrows F in the drawing.

Since the outer piezoelectric ceramic layer 34 is formed integrally with the piezoelectric ceramic layer 40, the outer electrode 38 is formed on the entire lower surface of the outer piezoelectric ceramic layer 34. This outer electrode 38 is connected to a negative terminal of the actuating power source V.

The laminated piezoelectric element 33 is constructed of a plurality of laminated piezoelectric ceramic layers having a piezoelectric effect and an electrostrictive strain effect. In FIG. 4, for example, three piezoelectric ceramic layers are laminated. To facilitate explanation, they are herein referred to as a first, a second, and a third piezoelectric ceramic layers 33A, 33B, and 33C in order downward from the uppermost layer of the laminated piezoelectric element 33. On the first through third piezoelectric ceramic layers 33A through 33C, first inner electrodes 36 are formed at positions corresponding to each ink pressure chamber 31 and second inner electrodes 37 are formed at positions corresponding to each dividing wall 35 between the adjacent ink pressure chambers 31.

As shown in FIG. 4, the first, second, and third piezoelectric ceramic layers 33A, 33B, and 33C are laminated on in order so that first inner electrodes 36 are stacked up and second inner electrodes 37 are similarly stacked up. The laminated piezoelectric element 33 having a structure described above is polarized in a direction in which the first through third piezoelectric ceramic layers 33A through 33C are laminated, as indicated by arrows E in FIG. 4. Each first inner electrode 36 formed in the first through third piezoelectric ceramic layers 33A through 33C is connected with a positive terminal of an actuating power source V via switches S. Each second inner electrode 37 is connected with a negative terminal of the actuating power source V.

It is noted that a manufacturing process of the laminated piezoelectric element 33 and the outer piezoelectric ceramic layer 34 and the like and a polarizing process thereof are the same as those described in Japanese Patent Application laid-open No. 4-125157 and others, and detail explanation of which will be omitted herein.

Figure 5:
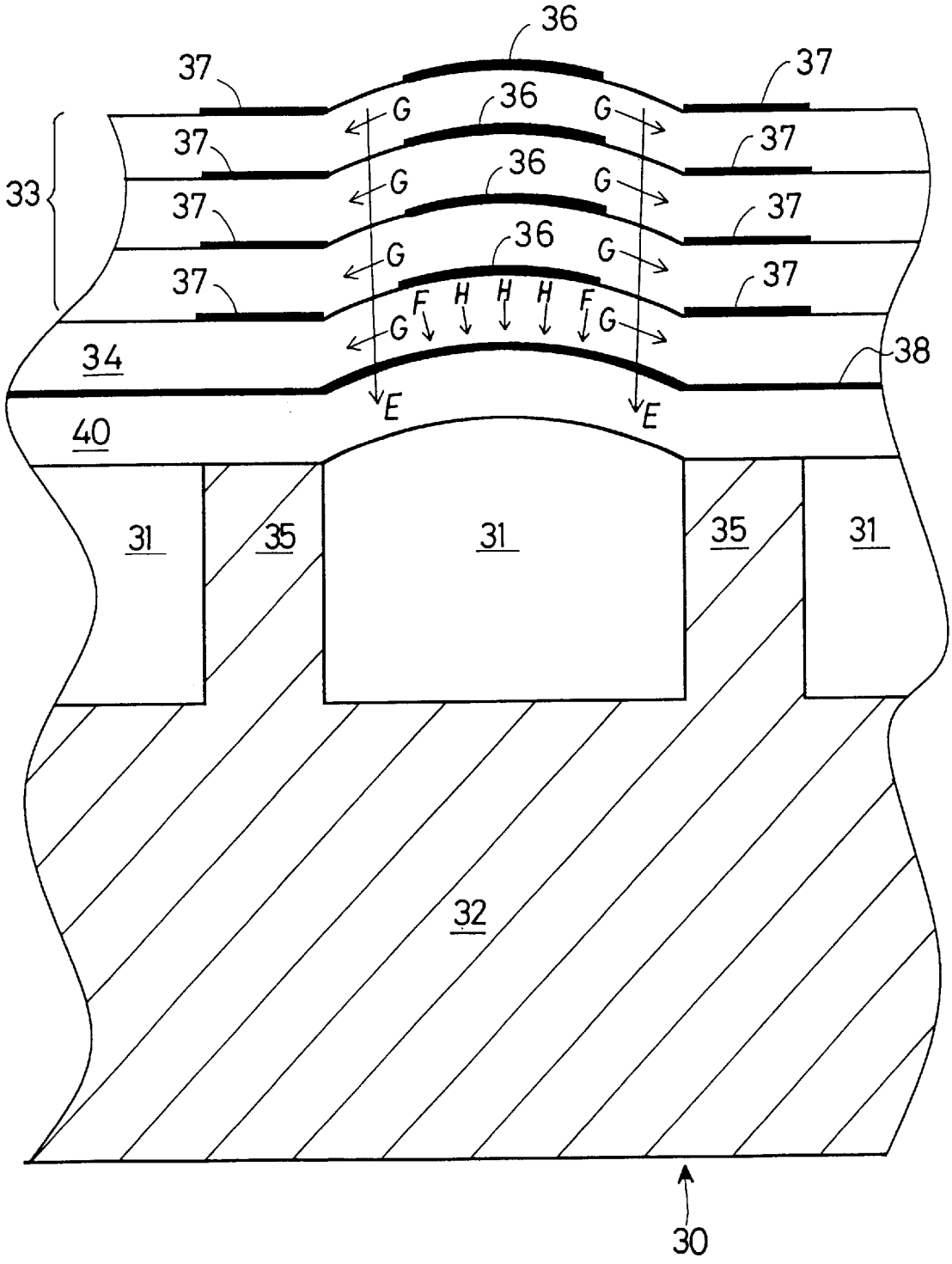
FIG. 5 is an enlarged view of a part of the array in which the laminated piezoelectric element is deformed in printing operation in the second embodiment.

Operation of the array 30 in the ink jet head 5 constructed as above will be explained referring to FIG. 5. FIG. 5 is an enlarged sectional view of a part of the array 30 in operation of printing by deforming the laminated piezoelectric element 33. Here, explanation is made about each operation of the laminated piezoelectric element 33 and the outer piezoelectric ceramic layer 34 when the switch S corresponding to a selected one of the ink pressure chamber 31, which is the second one from the right in FIG. 4, is actuated.

In FIG. 5, when the switch S is actuated via a controller (not shown) according to predetermined printing data, an actuating voltage is applied to each first inner electrode 36 from the actuating power source V. At this time, since each first inner electrode 36 is connected to a positive terminal of the actuating power source V and each second inner electrode 37 is connected to a negative terminal of the same, an electric field in a direction substantially perpendicular to the polarization direction indicated by arrows E is generated between the first and second inner electrodes 36 and 37. The direction of the electric field generated is indicated by arrows G in FIG. 5. The first through third piezoelectric layers 33A through 33C are partially deformed as shown in FIG. 5 in a shear mode due to the piezoelectric effect and the electrostrictive strain effect.

Furthermore, the outer electrode 38 of the outer piezoelectric ceramic layer 34 is connected to a negative terminal of the actuating power source V. When the appropriate switch S is actuated as described above, an electric field in the direction parallel to the polarization direction of the outer piezoelectric ceramic layer 34 indicated by arrows F is generated between the first inner electrode 36 and the outer electrode 38. The direction of the electric field generated is indicated by arrows H in FIG. 5. The outer piezoelectric ceramic layer 34 is partially deformed in the expansion mode due to the piezoelectric and electrostrictive strain effect. Specifically, the part of the outer piezoelectric ceramic layer 34 corresponding to the first inner electrode 36 expands in a direction of thickness and contracts in a direction parallel to the plane of the layer 34, whereby the outer piezoelectric ceramic layer 34 is partially bent upward as shown in the drawing by a bimorph effect between the layer 34 and the third piezoelectric ceramic layer 33A adjacent thereto.

It is noted that since the piezoelectric ceramic layer 40 which comes into contact with the ink in the ink pressure chamber 31 is formed of the same layer (constituent) as the first through third piezoelectric ceramic layers 33A through 33C, it is deformed, as shown in FIG. 5, following the shear mode deformation of the first through third piezoelectric ceramic layers 33A through 33C and the expansion mode deformation of the outer piezoelectric ceramic layer 34.

The outer piezoelectric ceramic layer 34 in the embodiment is sandwiched between the laminated piezoelectric element 33 and the piezoelectric ceramic layer 40, therefore, the bimorph effect generated as described above is somewhat lowered, whereas the outer piezoelectric ceramic layer 34 is deformed as shown in FIG. 5 because the laminated piezoelectric element 33 is thicker than the piezoelectric ceramic layer 40. In this case, if regarding the transducing effect of the laminated piezoelectric element 33 and the outer piezoelectric ceramic layer 34 as important, it is better to provide no piezoelectric ceramic layer 40. This is because the outer electrode 38 is connected to the negative terminal of the actuating power source V (ground) and therefore has hardly bad influence on the ink in the ink pressure chamber 31.

To the contrary, if considering as important the bad influence to be exerted on the ink in the ink pressure chamber 31 by the outer electrode 38 and also the transducing effect of the laminated piezoelectric element 33 and the outer piezoelectric ceramic layer 34, it is better to arrange a flexible insulating film and the like instead of the piezoelectric ceramic layer 41 under the outer piezoelectric ceramic layer 34.

In this way, various modifications are conceivable in the case where the outer piezoelectric ceramic layer 34 is provided under the laminated piezoelectric element 33, whereas every one of those modifications has both merits and demerits. An appropriate modification should be suitably adopted in consideration of the most importance merit.

As described above, when the switch S is actuated, the laminated piezoelectric element 33 is deformed in a shear mode due to the electric field generated in the direction perpendicular to the polarization direction of the laminated piezoelectric element 33 upon application of an actuating voltage from the actuating power source V to each first inner electrode 36, synchronously, the outer piezoelectric ceramic layer 34 is deformed in an expansion mode due to the electric field generated in the direction parallel to the polarization direction of the outer piezoelectric ceramic layer 34. The volume of the ink pressure chamber 31 is thus increased. Accordingly, ink is sucked into the ink pressure chamber 31 due to the increase in the volume and then ejected from an ink ejecting orifice onto a printing sheet not shown upon break of the actuating voltage, to print desired letters and the like on the sheet.

In this way, in the ink jet head 5 in the second embodiment, the laminated piezoelectric element 33 is deformed in the shear mode and the outer piezoelectric ceramic element 34 is deformed in the expansion mode at the same time in printing operation, so that the electromechanical transducing efficiency of the laminated piezoelectric element 33 can be enhanced with low actuating voltage and also cooperation of the shear mode deformation of the laminated piezoelectric element 33 and the expansion mode deformation of the outer piezoelectric layer 34 produces a bimorph deformation, thereby enabling a large deformation of the whole piezoelectric element. The use of the laminated piezoelectric element 33 can enhance the rigidity of the ink pressure chamber 31 and thus reduce the loss of the pressure generated in the ink pressure chamber 31.

Furthermore, the piezoelectric ceramic layer 40 is provided under the outer piezoelectric ceramic layer 34, which comes into contact with the ink in the ink pressure chamber 31, to operate as an insulating layer in order to prevent the outer electrode 38 existing under the outer piezoelectric ceramic layer 34 from becoming directly contact with the ink in the ink chamber 31, so that the outer electrode 38 can be protected from the ink in the ink pressure chamber 31 without providing any insulating layer such as an insulating film and any diaphragm and the like. The piezoelectric ceramic layer 40 operating as an insulating layer can be formed at the same time in the manufacture of the laminated piezoelectric element 33 and the outer piezoelectric ceramic layer 34, so that an increase in the cost of manufacture is not caused.

The piezoelectric ceramic layer 40 which comes into contact with the ink in the ink pressure chamber 31 is formed of the same layer as the piezoelectric ceramic layers 33A through 33C of the laminated piezoelectric element 33, so that the piezoelectric ceramic layer 40 can easily be deformed in accordance with the shear mode deformation of the laminated piezoelectric element 33 and the expansion mode deformation of the outer piezoelectric ceramic layer 34. Accordingly, the first inner electrodes 36 formed in the laminated piezoelectric element 33 and the outer electrode 38 formed in the outer piezoelectric ceramic layer 34 can be protected from the ink in the ink pressure chamber 31 without limiting the movement of the laminated piezoelectric element 33 and the outer piezoelectric ceramic layer 34.

It will be understood from the above description that the present invention can provide an ink jet head utilizing a laminated piezoelectric element constructed of at least two or more piezoelectric layers, polarized in a direction of the lamination and an outer piezoelectric layer provided on a plane of the laminated piezoelectric element, polarized in a direction of thickness, in which an electric field is produced in a direction perpendicular to the polarizing direction of the laminated piezoelectric element upon application of an actuating voltage to the laminated piezoelectric element, whereby the laminated piezoelectric element is deformed in a shear mode, while an electric field is produced in a direction parallel to the polarizing direction of the outer piezoelectric layer, whereby the outer piezoelectric layer is deformed in an expansion mode, so that the whole piezoelectric element can be largely deformed due to an cooperative effect of a shear mode deformation of the laminated piezoelectric element and an expansion mode deformation of the outer piezoelectric layer while enhancing electromechanical transducing efficiency of the laminated piezoelectric element with a low actuating voltage, and the rigidity of the ink pressure chamber is enhanced whereby loss of the pressure produced in the ink pressure chamber is reduced. It is also an object of the invention to provide an ink jet head capable of covering electrodes provided in the laminated piezoelectric element from ink in the ink chamber without providing additional insulating layers such as an insulating film and the like and diaphragms and also without limiting movement of the laminated piezoelectric element.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet head including ink pressure chambers formed in a cavity plate, each ink pressure chamber being open in one plane thereof;

at least two or more piezoelectric layers fixed on the cavity plate so as to cover the open plane of the ink pressure chamber, each of the at least two or more piezoelectric layers including first inner electrodes each disposed at a position corresponding to each said ink pressure chamber and second inner electrodes each disposed in a periphery of the ink pressure chamber;

a power source having a first terminal to which the first inner electrodes are connected and a second terminal to which the second inner electrodes are connected and has a polarity different from the first terminal;

said first and second inner electrodes produce electric deformation of a part of the piezoelectric layer upon application of an actuating voltage between the first and second inner electrodes from the power source, to jet ink from the ink pressure chamber via an ink jetting orifice, said ink jet head comprising:

a laminated piezoelectric element formed of said at least two or more piezoelectric layers so that said first and second inner electrodes are individually stacked up, the laminated piezoelectric element being polarized in a direction of lamination;

an outer piezoelectric layer stacked on a surface of the laminated piezoelectric element, the surface being positioned at an opposite side to the ink pressure chambers and the outer piezoelectric layer being polarized in a direction of thickness; and an outer electrode formed on one side of the outer piezoelectric layer, connected to said second terminal of the power source;

wherein, upon application of the actuating voltage from the power source, an electric field in a direction perpendicular to the polarization direction of the laminated piezoelectric element is generated in the laminated piezoelectric element to deform the same in a shear mode, and an electric field in a direction parallel to the polarization direction of the outer piezoelectric layer is generated in the outer piezoelectric layer to deform the same in an expansion mode.

2. The ink jet head according to claim 1, wherein the first terminal of the power source is plus terminal and the second terminal thereof is minus terminal.

3. The ink jet head according to claim 2, wherein the laminated piezoelectric element and the outer piezoelectric layer are deformed so as to reduce volume of the ink pressure chamber when the actuating voltage is applied to the first inner electrodes through the plus terminal and is applied to both the second inner electrodes and the outer electrode of the outer piezoelectric layer through the minus terminal.

4. The ink jet head according to claim 3, wherein the outer piezoelectric layer is deformed in the expansion mode so as to expand in the direction of thickness and contract in a direction along a plane thereof.

5. The ink jet head according to claim 4, wherein the outer piezoelectric layer is bent downward based on bimorph effect produced between the outer piezoelectric layer and the piezoelectric layer in the laminated piezoelectric element adjacent thereto.

6. The ink jet head according to claim 1, wherein one of the piezoelectric layers formed the laminated piezoelectric element, which comes into contact with ink in the ink pressure chamber, operates as an insulating layer.

7. The ink jet head according to claim 6, wherein the piezoelectric layer being in contact with the ink in the ink pressure chamber is deformed in accordance with deformation of the laminated piezoelectric element.

8. The ink jet head according to claim 1, wherein the periphery of ink pressure chamber is divided by a dividing wall and the second inner electrodes are arranged corresponding to the dividing wall.

9. The ink jet head according to claim 1, wherein the laminated piezoelectric element and the outer piezoelectric layer are deformed so as to reduce the volume of the ink pressure chamber when the actuating voltage is applied to the first inner electrodes through the first terminal and is applied to both the second inner electrodes and the outer electrode of the outer piezoelectric layer through the second terminal.

10. An ink jet head including ink pressure chambers formed in a cavity plate, each ink pressure chamber being open in one plane thereof;

at least two or more piezoelectric layers fixed on the cavity plate so as to cover the open plane of the ink pressure chamber, each of the at least two or more piezoelectric layers including first inner electrodes each disposed at a position corresponding to each said ink pressure chamber and second inner electrodes each disposed in a periphery of the ink pressure chamber;

a power source having a first terminal to which the first inner electrodes are connected and a second terminal to which the second inner electrodes are connected and has a polarity different from the first terminal;

said first and second inner electrodes produce electric deformation of a part of the piezoelectric layer upon application of an actuating voltage between the first and second inner electrodes from the power source, to jet ink from the ink pressure chamber via an ink jetting orifice, said inkjet head comprising:

a laminated piezoelectric element formed of said at least two or more piezoelectric layers so that said first and second inner electrodes are individually stacked up, the laminated piezoelectric element being polarized in a direction of lamination;

an outer piezoelectric layer stacked on a surface of the laminated piezoelectric element, the outer piezoelectric layer being positioned between the ink pressure chambers and the laminated piezoelectric element, the outer piezoelectric layer being polarized in a direction of thickness; and an outer electrode formed on one side of the outer piezoelectric layer, connected to said second terminal of the power source;

wherein, upon application of the actuating voltage from the power source, an electric field in a direction perpendicular to the polarization direction of the laminated piezoelectric element is generated in the laminated piezoelectric element to deform the same in a shear mode, and an electric field in a direction parallel to the polarization direction of the outer piezoelectric layer is generated in the outer piezoelectric layer to deform the same in an expansion mode.

11. The ink jet head according to claim 10, wherein the first terminal of the power source is plus terminal and the second terminal thereof is minus terminal.

12. The ink jet head according to claim 11, wherein the laminated piezoelectric element and the outer piezoelectric layer are deformed so as to increase volume of the ink pressure chamber when the actuating voltage is applied to the first inner electrodes through the plus terminal and is applied to both the second inner electrodes and the outer electrode of the outer piezoelectric layer through the minus terminal.

13. The ink jet head according to claim 12, wherein the outer piezoelectric layer is deformed in the expansion mode so as to expand in the direction of thickness and contract in a direction along a plane thereof.

14. The ink jet head according to claim 13, wherein the outer piezoelectric layer is bent upward based on bimorph effect produced between the outer piezoelectric layer and the piezoelectric layer in the laminated piezoelectric element adjacent thereto.

15. The ink jet head according to claim 10, wherein a piezoelectric layer which comes into contact with ink in the ink pressure chamber is disposed on a lower surface of the outer piezoelectric layer.

16. The ink jet head according to claim 10, wherein the laminated piezoelectric element and the outer piezoelectric layer are deformed so as to reduce the volume of the ink pressure chamber when the actuating voltage is applied to the first inner electrodes through the first terminal and is applied to both the second inner electrodes and the outer electrode of the outer piezoelectric layer through the second terminal.

* * * * *